US006302759B1

(12) United States Patent
Hsieh

(10) Patent No.: US 6,302,759 B1
(45) Date of Patent: Oct. 16, 2001

(54) FIN STRUCTURE OF BALLOON

(76) Inventor: Fei-Che Hsieh, No. 43, Lane 53, Han-Sang E. Road, Taipei (TW)

( * ) Notice: Subject to any disclaimer, the term of this patent is extended or adjusted under 35 U.S.C. 154(b) by 0 days.

(21) Appl. No.: 09/383,361

(22) Filed: Aug. 26, 1999

(30) Foreign Application Priority Data

Feb. 10, 1999 (TW) ..... 88202254

(51) Int. Cl.[7] ..... A63H 3/06
(52) U.S. Cl. ..... 446/220
(58) Field of Search ..... 446/220, 221, 446/222, 223, 224, 225, 226, 231; 244/31, 33

(56) References Cited

U.S. PATENT DOCUMENTS 2,398,745 * 4/1946 Jalbert .
2,707,603 * 5/1955 Moore .
2,826,000 * 3/1958 Fischman et al. .
3,064,926 * 11/1962 Jalbert .
3,225,488 * 12/1965 Goldfarb .
3,871,603 * 3/1975 Menke et al. ..... 244/125
3,993,269 * 11/1976 Crosby ..... 244/33
4,125,233 * 11/1978 Winker et al. ..... 244/33
4,848,386 * 7/1989 Cooper ..... 135/90
5,395,276 * 3/1995 Valentino ..... 446/217
5,456,426 * 10/1995 Wexler ..... 244/127
5,882,240 * 3/1999 Larsen ..... 446/225

* cited by examiner

*Primary Examiner*—Jacob K. Ackun, Jr.
*Assistant Examiner*—Jeffrey Carlson
(74) *Attorney, Agent, or Firm*—Rosenberg, Klein & Lee

(57) ABSTRACT

A fin of a balloon includes a frame constituted by a pair of opposite and spaced support rods having first and second ends and a cross rod connected between first ends of the support rods. A flexible sheet of material is attached to the frame by having edges thereof forming passage fit over the support rods and the cross rod. Two connectors are mounted to the balloon for receiving and releasably retaining the second ends of the support rods thereby mounting the fin to the balloon.

1 Claim, 11 Drawing Sheets

FIN STRUCTURE OF BALLOON

FIELD OF THE INVENTION

The present invention generally relates to a balloon, and in particular to a fin structure of a balloon.

BACKGROUND OF THE INVENTION

Large balloons have been widely used for advertisement and other purposes. FIG. 11 of the attached drawings shows an example of a conventional balloon having an airship-shape, designated by reference A. The balloon A has a number of tail fins B integrally formed with the balloon A whereby when the balloon A is inflated, air gets into the fins B and expands the fins B. The expanded or inflated fins B are kept in shape and position by the compressed air filled therein. Besides decoration, the fins B serve no purposes.

Thus, it is desired to provide a fin structure of a balloon which also serves to stabilize the balloon.

SUMMARY OF THE INVENTION

Accordingly, an object of the present invention is to provide a fin structure of a balloon for stabilizing the balloon.

Another object of the present invention is to provide a fin structure of a balloon which is easily to assemble/disassemble.

To achieve the above object, in accordance with the present invention, there is provided a fin structure of a balloon comprising a frame having a pair of opposite and spaced support rods having first and second ends and a cross rod connected between first ends of the support rods. A flexible sheet of material is attached to the frame by having edges thereof forming passage fit over the support rods and the cross rod. Two connectors are mounted to the balloon for receiving and releasably retaining the second ends of the support rods thereby mounting the fin to the balloon.

BRIEF DESCRIPTION OF THE DRAWINGS

The present invention will be apparent to those skilled in the art by reading the following description of preferred embodiments thereof, with reference to the accompanying drawings, in which.

DETAILED DESCRIPTION OF THE PREFERRED EMBODIMENTS

Figure 9:
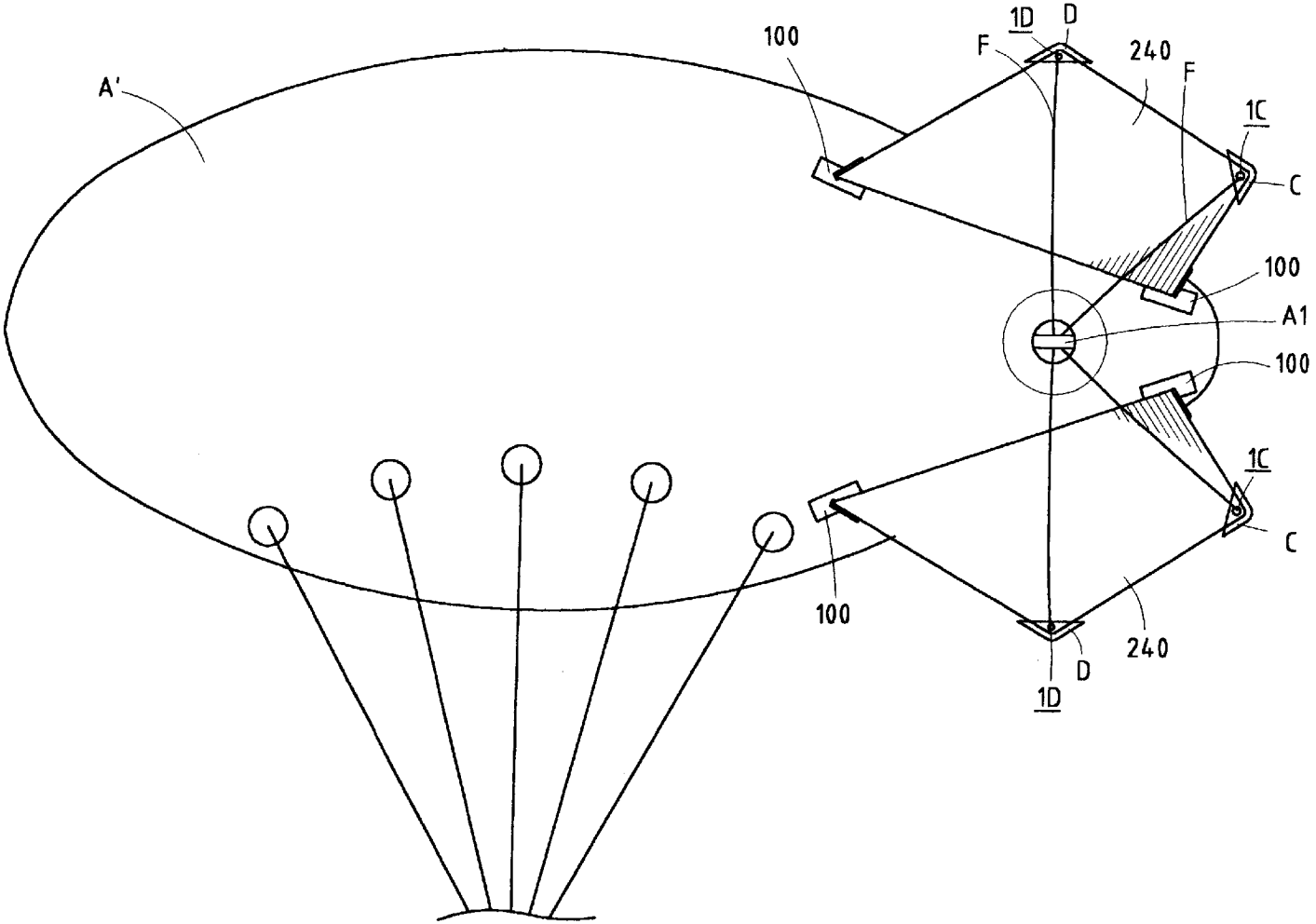
FIG. 9 is a schematic view showing an airship-shaped balloon to which a number of the fins in accordance with the present invention are mounted.
Figure 10:
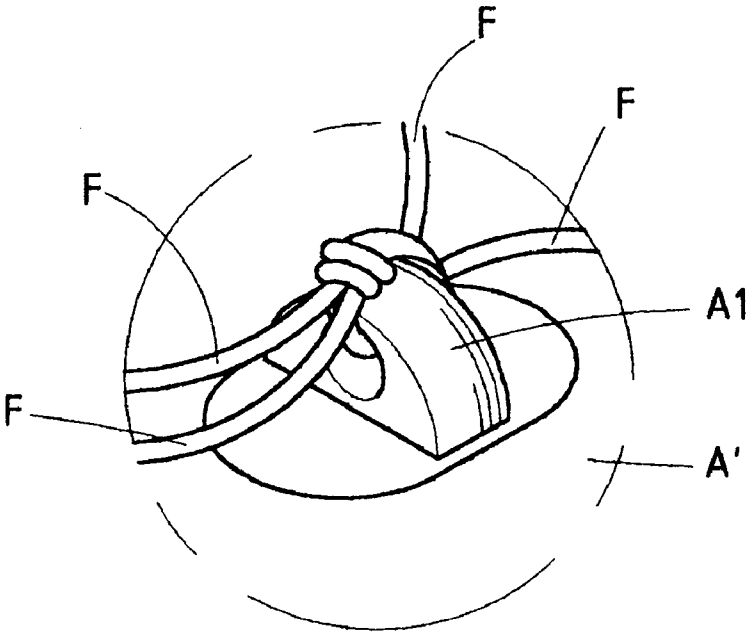
FIG. 10 is an enlarged view of a portion of the balloon showing an anchoring ring mounted to the balloon.
Figure 11:
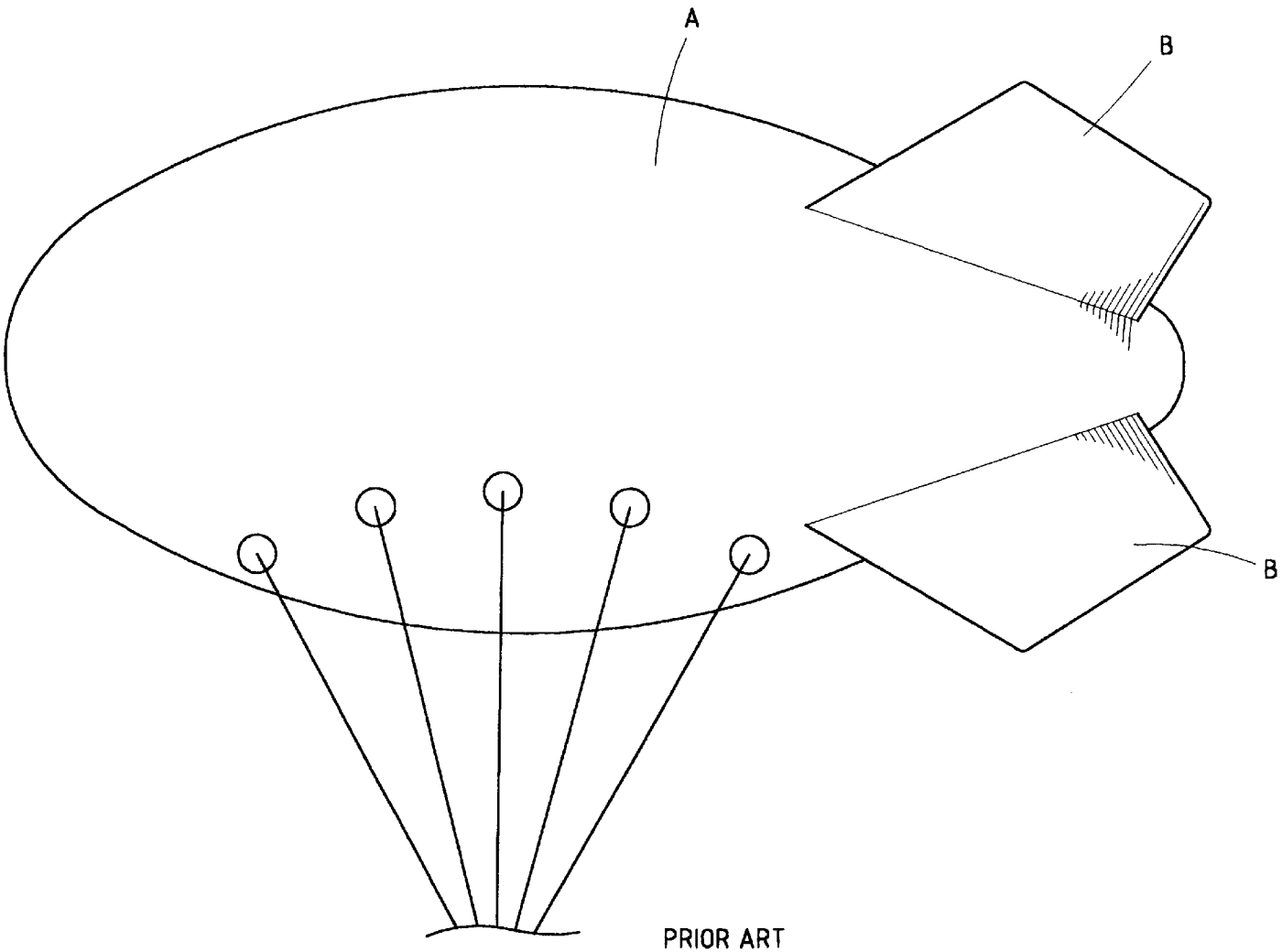
FIG. 11 is a schematic view showing an airship-shaped balloon having conventional fins.

With reference to the drawings and in particular to FIGS. 1–4, a fin 200 constructed in accordance with the present invention comprises a plurality of connectors 100 for mounting the fin to a balloon A' (see FIG. 9). In the embodiment illustrated, a number of fins 200 are mounted to the balloon A' as shown in FIG. 9.

The connectors 100 may be attached to the balloon A' by any suitable means, such as ultra-sonic welding. A socket 110 is mounted to each connector 100 for receiving and retaining the fin 200 on the balloon A'. The sockets 110 may be made of any suitable material, such as plastics.

Each fin 200 comprises a frame made of a pair of opposite and spaced support rods 210, 220 each having a proximate end received in the corresponding socket 110 and a distal end connected to each other by a cross rod 230. The cross rod 230 has opposite ends respectively fixed to the distal ends of the support rods 210, 220 by connection members C, D. Each connection member C, D defines two bores which are arranged to form a desired angle between central axes thereof for respectively receiving the corresponding ends of the cross rod 230 and the support rod 210, 220. In the embodiment illustrated, each connection member C, D comprises a bent tubular element 2C, 2D forming a V-shape and having open ends for defining the two bores. The connection member C forms a 90 degree included angle, while the connection member D forms an obtuse angle. However, other angles may be taken between the central axes of the bores of the connection member C, D. A reinforcing rib (not labeled) is formed between the limbs of the V-shape of each tubular element 2C, 2D with an eyelet 1C, 1D defined therein. The rods 210, 220, 230 may be fixed together by other means, such as welding.

A flexible sheet of material 240, such as plastic film or a piece of clothe, is attached to the frame of the fin 200 by having edges thereof fixed to the rods 210, 220, 230. In the embodiment illustrated the edges of the sheet 240 are folded and attached to the sheet 240 itself by means of for example seaming or adhesives to form passages 241, 242, 243 substantially coextensive therewith. The rods 210, 220, 230 are received in the corresponding passages 241, 242, 243 thereby securing the sheet 240 to the frame of the fin 200.

Figure 1:
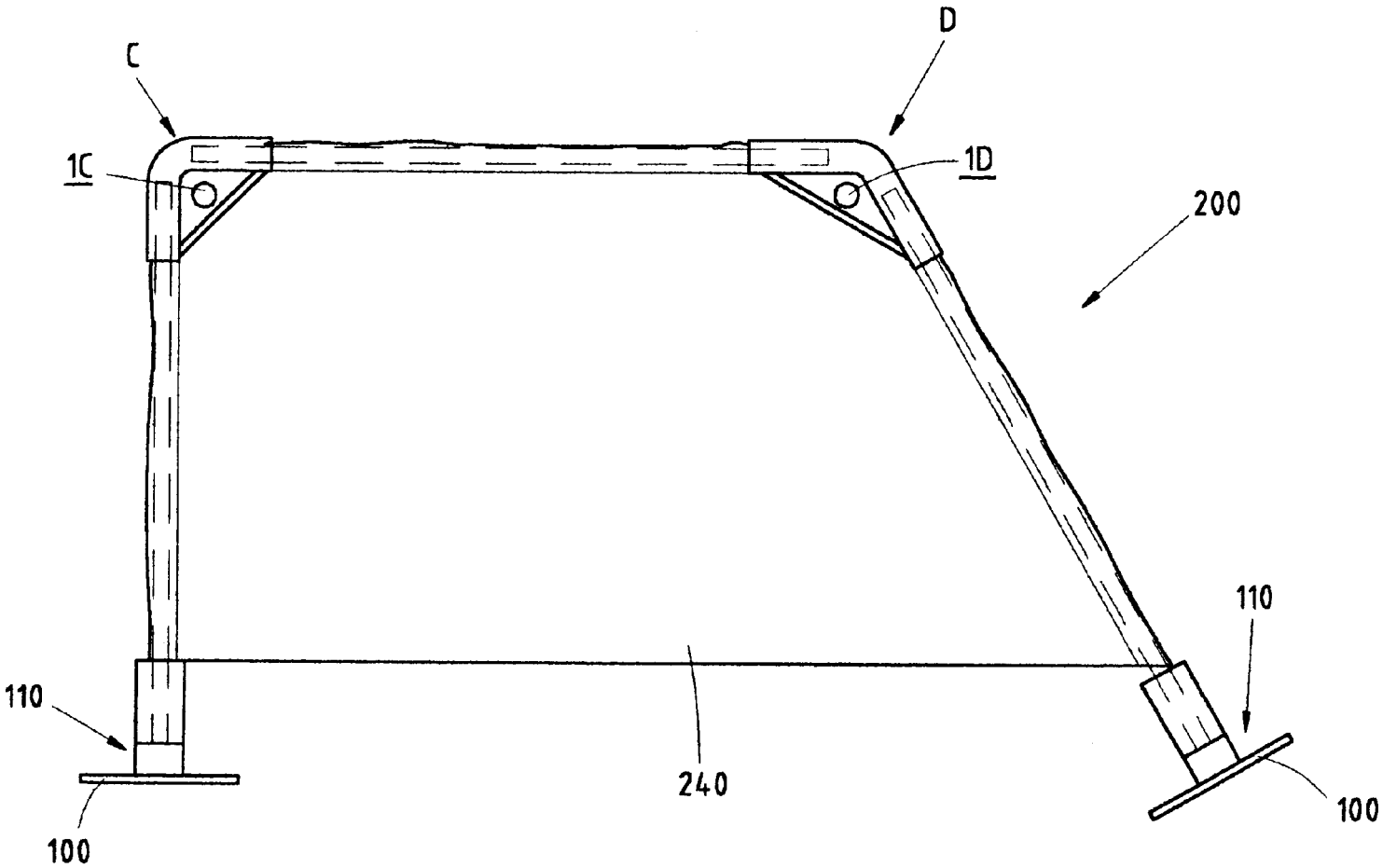
FIG. 1 is a side elevational view of a fin of a balloon constructed in accordance with the present invention.
Figure 2:
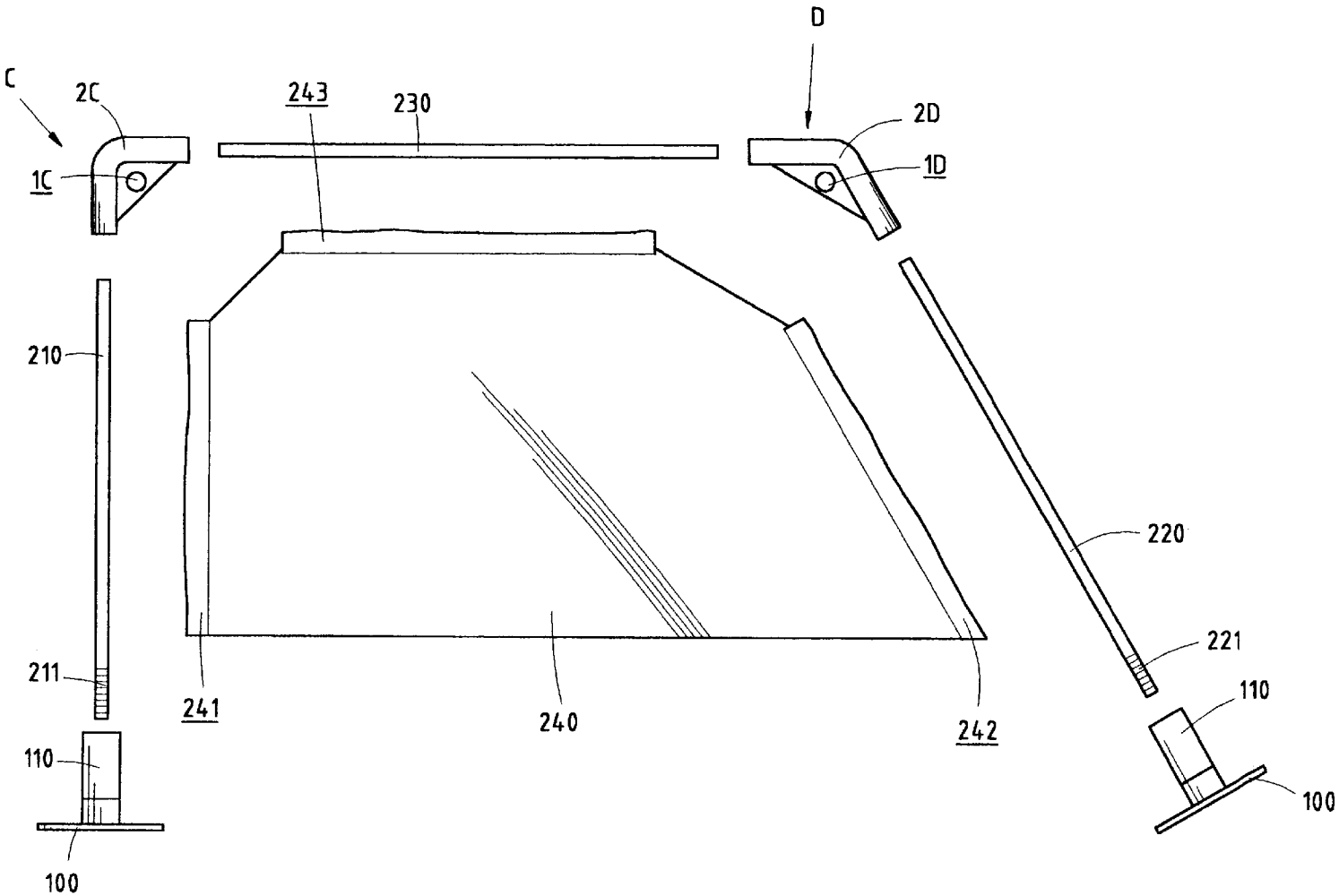
FIG. 2 is an exploded view of the fin.
Figure 3:
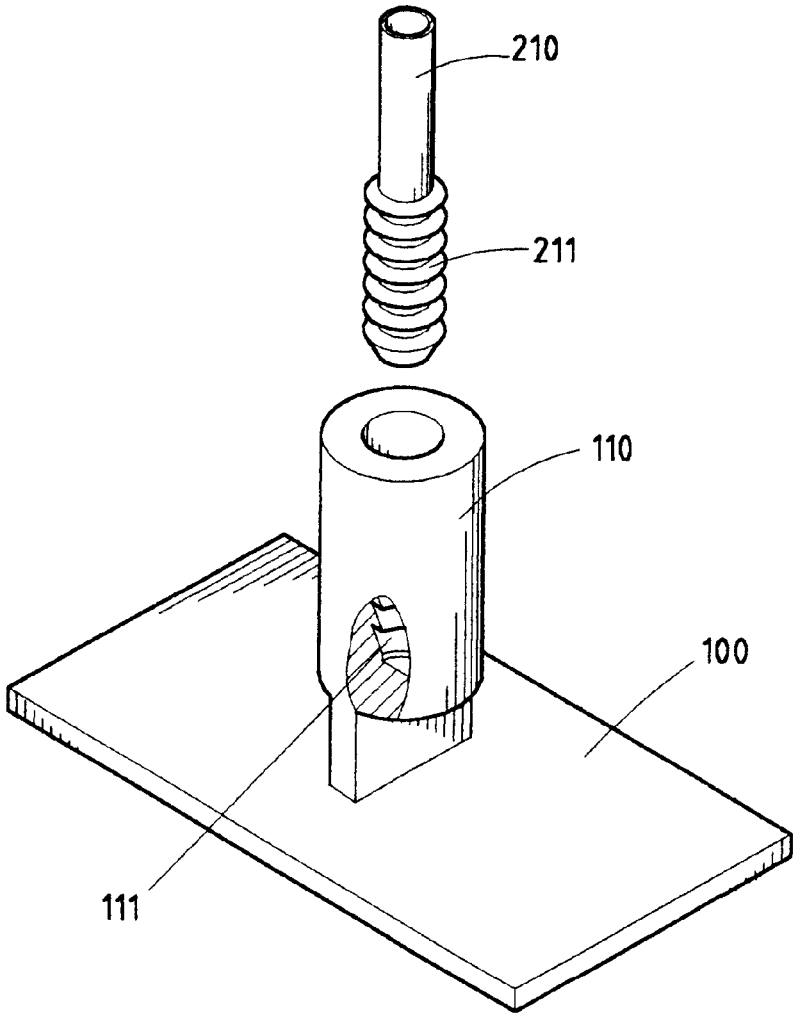
FIG. 3 is a perspective view of a fixing device for mounting a support rod to a connector of the fin of the present invention.
Figure 4:
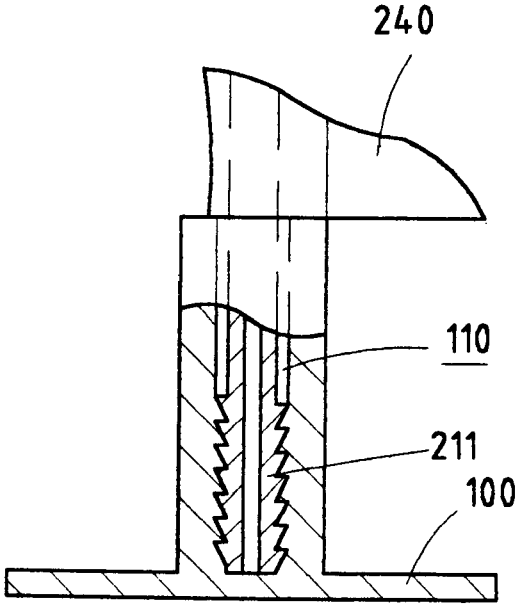
FIG. 4 is a side elevational view, partially broken, of the fixing device mounting the support rod to the connector.

Also referring to FIGS. 3 and 4, the proximate ends of the support rods 210, 220 form fixing means for being received and retained in the sockets 110 of the connectors 100. In the embodiment illustrated in FIGS. 2–4, the fixing means comprise an external threading 211, 221 formed on the proximate end of each support rod 210, 220. Each socket 110 has an inner threading 111 for engaging with the external threading 211, 221 of the corresponding support rod 210, 220. Preferably, the threading 111 is counterclockwise.

Figure 5:
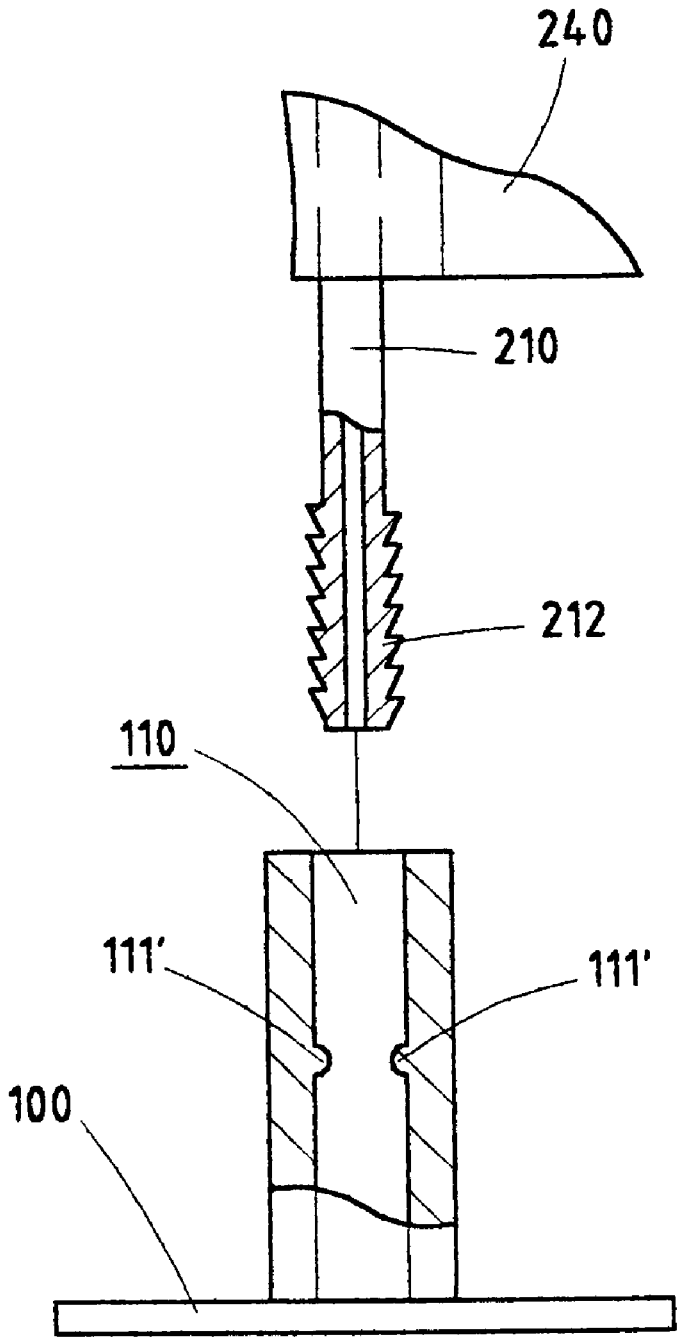
FIG. 5 is a side elevational view, partially broken, showing a fixing device in accordance with a second embodiment of the present invention.

Other fixing means may also be used to retain the frame to the connectors 100. A second embodiment of the fixing means is shown in FIG. 5, comprising a threading 212, preferably counterclockwise, formed on each support rod

Figure 6:
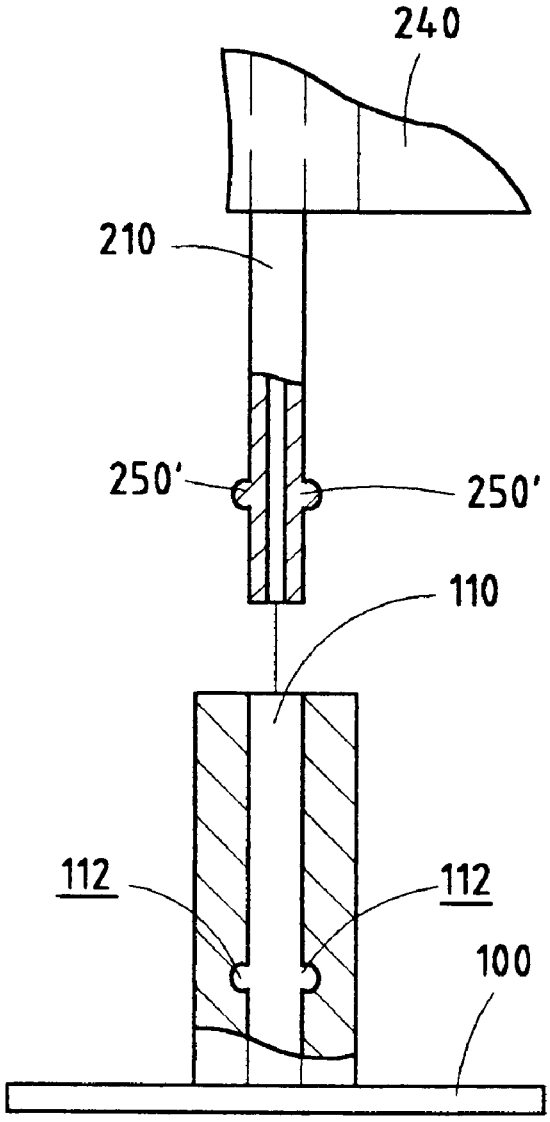
FIG. 6 is similar to FIG. 5 but showing a fixing device in accordance with a third embodiment of the present invention.

210, 220. The threading 212 engages with a pair of projections 111' formed in the corresponding socket 110 thereby retaining the support rod 210, 220 in the socket 110. FIG. 6 shows a third embodiment of the fixing means comprising a pair of projections 250' receivingly engaging with recesses 112 defined in an inside surface of the corresponding socket 110.

Figure 7:
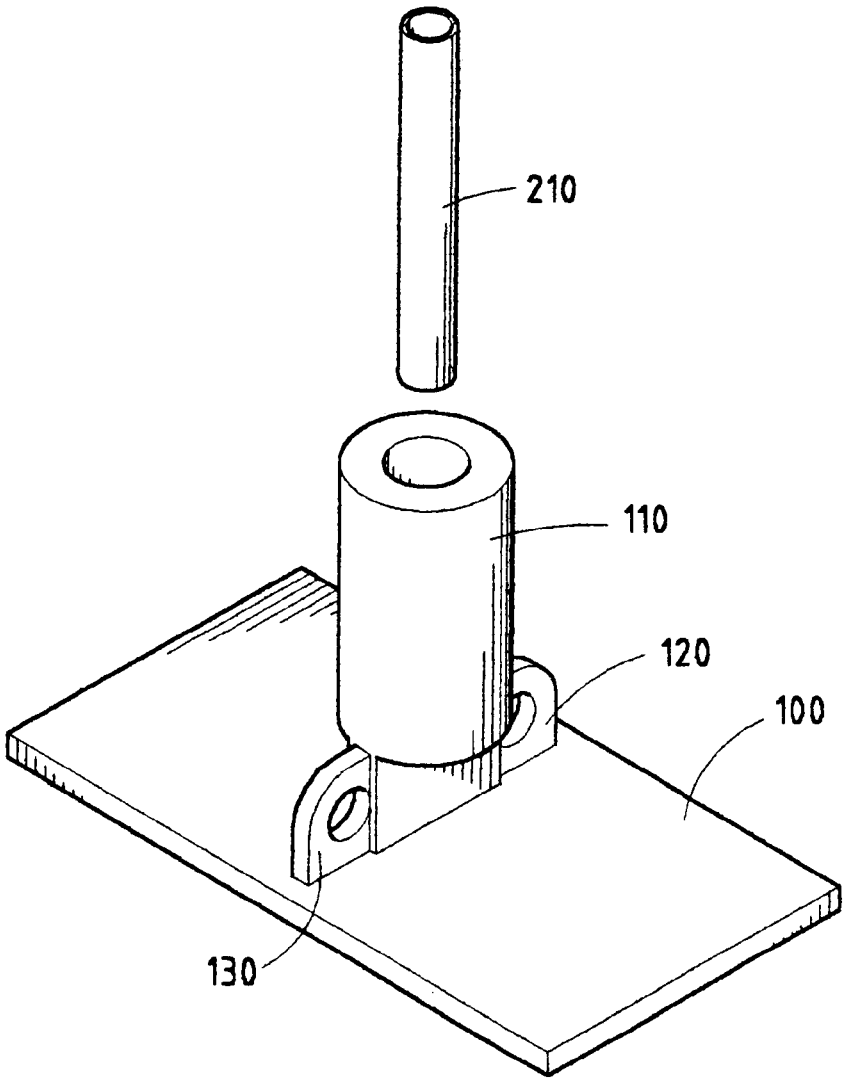
FIG. 7 is a perspective view showing the connector in accordance with a fourth embodiment of the present invention.
Figure 8:
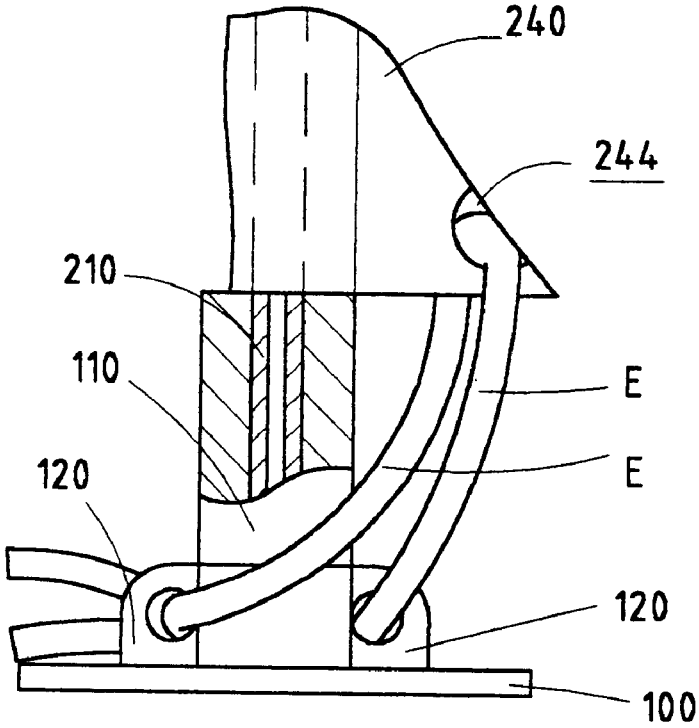
FIG. 8 is similar to FIG. 6 but showing a fixing device in accordance with the fourth embodiment of the present invention.

FIGS. 7 and 8 show a fourth embodiment of the fixing means comprising a pair of lugs 120 each defining a through hole 130. A rope E extends through the holes 130 and a hole 244 defined in the sheet 240 that is attached to the support rods 210, 220 for securing the sheet 240 and thus the support rod 210, 220 to the corresponding connector 100.

FIG. 9 shows an airship-shaped balloon A' to which a plurality of the fins 200 of the present invention are mounted. In the manufacture of the balloon A', the manufacturers only need to add the connectors 100 to the balloon A', not the whole fin. This simplifies the manufacturing process. The fins 200 are then mounted to the corresponding connectors 100. An efficient assembly of the balloon A' may thus be obtained. Furthermore, anchoring means may be provided to more securely retaining the fins 200. In the embodiment illustrated, the anchoring means comprises an anchoring ring A1 fixed to the balloon A'. Ropes F connect between the anchoring ring A1 and the eyelets 1C, 1D defined in the connection members C, D of each fin 200 for facilitating stabilizing the balloon A'.

Although the present invention has been described with respect to the preferred embodiments, it is contemplated that a variety of modifications, variations and substitutions may be done without departing from the scope of the present invention that is intended to be defined by the appended claims.

What is claimed is:

1. A fin combined with a balloon, comprising:

the balloon;

a frame comprising a pair of opposite and spaced support rods having first and second ends and a cross rod connected between respective first ends of the support rods, the frame including a pair of connection members each coupling a respective first end of one of support rods with the cross rod, each connection member being formed by an angularly contoured tubular element having a reinforcing rib bridging an enclosed angle of the angular contour;

a flexible sheet of material having first, second, and third edges respectively fixed to the pair of support rods and the cross rod, a fourth edge of the flexible sheet opposite to the third edge thereof fixed to the cross rod being devoid of support rods and spaced from the balloon, the flexible sheet having a pair of longitudinally spaced first holes formed therethrough adjacent the fourth edge;

a pair of connectors mounted to the balloon in longitudinally spaced relationship for receiving and respectively releaseably retaining the second end of each support rod to the balloon, each connector having a pair of lugs extending therefrom, each lug having a second hole formed therethrough; and, a pair of ropes, each of the ropes being tied between a respective one of the first holes in the flexible sheet and the second holes in the lugs of a respective connector.

* * * * *